US010249246B2

(12) United States Patent
Li

(10) Patent No.: US 10,249,246 B2
(45) Date of Patent: Apr. 2, 2019

(54) GOA CIRCUIT

(71) Applicant: Wuhan China Star Optoelectronics Technology Co., Ltd., Wuhan (CN)

(72) Inventor: Yafeng Li, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 107 days.

(21) Appl. No.: 15/506,236

(22) PCT Filed: Dec. 30, 2016

(86) PCT No.: PCT/CN2016/113326
§ 371 (c)(1),
(2) Date: Feb. 24, 2017

(87) PCT Pub. No.: WO2018/119968
PCT Pub. Date: Jul. 5, 2018

(65) Prior Publication Data

US 2018/0218685 A1 Aug. 2, 2018

(30) Foreign Application Priority Data

Dec. 27, 2016 (CN) ..... 2016 1 1230448

(51) Int. Cl.
*G09G 3/3266* (2016.01)
*G09G 3/3258* (2016.01)
*G09G 3/36* (2006.01)

(52) U.S. Cl.
CPC ..... *G09G 3/3266* (2013.01); *G09G 3/3258* (2013.01); *G09G 3/3648* (2013.01); *G09G 3/3677* (2013.01); *G09G 3/3696* (2013.01); *G09G 2310/0283* (2013.01); *G09G 2310/08* (2013.01)

(58) Field of Classification Search
CPC .. G09G 3/3648; G09G 3/3266; G09G 3/3677; G09G 3/3258; G09G 3/3696; G09G 2310/0283; G09G 2310/08
See application file for complete search history.

(56) References Cited

U.S. PATENT DOCUMENTS

2016/0086562 A1* 3/2016 Tan ..... G09G 3/3677 345/215
2017/0032752 A1* 2/2017 Huang ..... G09G 3/3648
2017/0116924 A1* 4/2017 Zhang ..... G09G 3/3233

FOREIGN PATENT DOCUMENTS

CN 106128379 A 11/2016

* cited by examiner

*Primary Examiner* — Lunyi Lao
*Assistant Examiner* — Johny Lau
(74) *Attorney, Agent, or Firm* — Leong C. Lei

(57) ABSTRACT

The invention provides a GOA circuit, comprising a plurality of GOA units, for a positive integer n, n-th GOA unit comprising: a first TFT (T1), a second TFT (T2), a third TFT (T3), a fourth TFT T(4), a fifth TFT (T5), a sixth TFT (T6), a seventh TFT (T7), an eighth TFT (T8), a ninth TFT (T9), a tenth TFT (T10), a first capacitor (C1) and a second capacitor (T2). The invention, based on known GOA circuit, uses T9 and T10 so as to achieve forward and backward scanning without D2U and U2D control signals, which facilitates narrow border design and simplifies corresponding driving timing and reduce IC cost.

14 Claims, 4 Drawing Sheets

GOA CIRCUIT

BACKGROUND OF THE INVENTION

1. Field of the Invention

The present invention relates to the field of display, and in particular to a gate driver on array (GOA) circuit.

2. The Related Arts

The gate driver on array (GOA) technology is the array substrate column drive technology, by using the array substrate process for the LCD panel to manufacture the driver circuit for the gate scan line on the array substrate to achieve driving of the gates by line-by-line scanning.

The GOA circuit must provide the forward and backward scanning function. The common approach is to add a U2D and a D2U scanning units. For forward scanning, the forward scanning control signal U2D is high voltage, and the backward scanning control signal is low voltage. This approach requires the integrated circuit (IC) to provide the function to output the signals, which restricts the choice for the IC. Moreover, because the co-existence of U2D and D2U, the layout also imposes restrictions on the narrow border design, and a higher IC cost will incur.

Refer to FIG. 1. A known GOA circuit, applicable to low temperature polysilicon (LPTS) panel comprises: a plurality of cascade GOA units, an n-th GOA unit outputting a horizontal n-th scan signal comprising: a first thin film transistor (TFT) T1, a gate of the first TFT T1 connected to the signal output node Gn−2 of the (n−2)-th GOA unit, a source and a drain connected respectively to a node H and an input forward scan control signal U2D; a second TFT T2, a gate of the second TFT T2 connected to a node Q, a source and to drain connected respectively to the signal output node Gn and an input clock signal CKV1; a third TFT T3, a gate of the third TFT T3 connected to the signal output node Gn+2 of the (n+2)-th GOA unit, a source and adrain connected respectively to the node H and a backward scan control signal D2U; a fourth TFT T4, a gate of the fourth TFT T4 connected to a third node P, a source and a drain connected respectively to the signal output node Gn and a constant low voltage VGL; a fifth TFT T5, a gate of the fifth TFT T5 connected to a constant high voltage VGH, the source and the drain connected respectively to the first node H and the second node Q; a sixth TFT T6, a gate of the sixth TFT T6 connected to the third node P, a source and a drain connected respectively to the first node H and the constant low voltage VGL; a seventh TFT T7, a gate of the seventh TFT T7 connected to the first node H, a source and a drain connected respectively to the third node P and the constant low voltage VGL; an eighth TFT T8, a gate of the eighth TFT T8 connected to the clock signal CKV3, a source and a drain connected respectively to the third node P and the constant high voltage VGH; and a first capacitor C1, having two ends connected respectively to the second node Q and the signal output node Gn; a second capacitor C2, having two ends connected respectively to the third node P and the constant low voltage VGL. The node Q is for controlling the gate driving signal output; the node P is the stability point for maintaining the low voltage for node Q and Gn. The dash box in FIG. 1 shows the forward and backward scanning unit for the GOA circuit.

Refer to FIG. 2, which shows a schematic view of timing sequence of forward scanning in the GOA circuit of FIG. 1. Also referring to FIG. 1, the forward scanning of the circuit is described as follows:

During forward scanning, U2D is at high voltage and the D2U is at low voltage.

Stage 1, pre-charging: Gn−2 and U2D are at high voltage, T1 is conductive, node H is pre-charged, when H is at high voltage, T5 is conductive, node Q is pre-charged; when node H is at high voltage, T7 is conductive and node P is lowered down.

Stage 2, Gn outputting high voltage: in Stage 1, node Q is pre-charged and C1 maintains the charges, T2 is conductive, CKV1 outputs high voltage to Gn.

Stage 3, Gn outputting low voltage: C1 maintains the high voltage of node Q, and the low voltage of CKV1 lowers the Gn.

Stage 4, node Q lowered to VGL: when Gn+2 is at high voltage, D2U at this point is at low voltage, T3 is conductive and node Q is lowered to VGL.

Stage 5, node Q and Gn maintained at low voltage: when node Q becomes at low voltage, T7 is cut-off. When CKV3 jumps to high voltage, T8 is conductive, node P is charged to high voltage, then T4 and T6 are conductive to ensure that node Q and Gn are maintained at low voltage; at the same time, C2 maintains the node P at high voltage.

Refer to FIG. 3, which shows a schematic view of timing sequence of backward scanning in the GOA circuit of FIG. 1. Also referring to FIG. 1, the backward scanning of the circuit is described as follows:

During backward scanning, D2U is at high voltage and the U2D is at low voltage.

Stage 1, pre-charging: Gn+2 and D2U are at high voltage, T3 is conductive, node H is pre-charged; when node H is at high voltage, T5 stays in conductive state, and node Q is pre-charged; when node H is at high voltage, T7 is conductive and node P is lowered down.

Stage 2, Gn outputting high voltage: in Stage 1, node Q is pre-charged and C1 maintains the charges, T2 is conductive, CKV1 outputs high voltage to Gn.

Stage 3, Gn outputting low voltage: C1 maintains the high voltage of node Q, and the low voltage of CKV1 lowers the Gn.

Stage 4, node Q lowered to VGL: when Gn−2 is at high voltage, U2D at this point is at low voltage, T1 is conductive and node Q is lowered to VGL.

Stage 5, node Q and Gn maintained at low voltage: when node Q becomes at low voltage, T7 is cut-off. When CKV3 jumps to high voltage, T8 is conductive, node P is charged, then T4 and T6 are conductive to ensure that node Q and Gn are maintained at low voltage; at the same time, C2 keeps the node P at high voltage.

SUMMARY OF THE INVENTION

The object of the present invention is to provide a GOA circuit, without the need to provide the forward scan control signal D2U and the backward scan control signal U2D to realize the forward-and-backward scan.

To achieve the above object, the present invention provides a GOA circuit, comprising: a plurality of cascade GOA units, for a positive integer n, the n-th GOA unit comprising:

a first thin film transistor (TFT), a gate of the first TFT connected to a constant high voltage, a first source/drain connected to an signal output node of (n−2)th GOA unit, a second source/drain connected to a first source/drain of a ninth TFT;

a ninth TFT, a gate of the ninth TFT connected to the signal output node of the (n−2)th GOA unit, and a second source/drain connected to a third node;

a third TFT, a gate of the third TFT connected to the constant high voltage, a first source/drain connected to an signal output node of (n+2)th GOA unit, a second source/drain connected to a first source/drain of a tenth TFT;

a tenth TFT, a gate of the tenth TFT connected to the signal output node of the (n+2)th GOA unit, and a second source/drain connected to the third node;

a seventh TFT, a gate of the seventh TFT connected to the third node, a source and a drain connected respectively to a second node and a constant low voltage;

a sixth TFT, a gate of the sixth TFT connected to the second node, a source and a drain connected respectively to the third node and the constant low voltage;

a fifth TFT, a gate of the fifth TFT connected to the constant high voltage, a source and a drain connected respectively to the third node and the first node;

an eighth TFT, a gate of the eighth TFT inputted a second clock signal, a source and a drain connected respectively to the second node and the constant high voltage;

a second TFT, a gate of the second TFT connected to the first node, a source and a drain connected respectively to the signal output node of n-th GOA unit and an input first clock signal;

a first capacitor, having the two ends connected respectively to the first node and the signal output node of n-th GOA unit;

a fourth TFT, a gate of the fourth TFT connected to the second node, a source and a drain connected respectively to the signal output node of n-th GOA unit and the constant low voltage;

a second capacitor, having the two ends connected respectively to the second node and the constant low voltage.

According to a preferred embodiment of the present invention, the first clock signal and the second clock signal are rectangular waves having a duty ratio of 0.25, and the waveforms between the first clock signal and the second clock signal differ by a half cycle.

According to a preferred embodiment of the present invention, for the first GOA unit in the cascade, when starting forward scanning, the signal output node of (n−2)th GOA unit inputs the high voltage signal as an activation signal.

According to a preferred embodiment of the present invention, for the second GOA unit in the cascade, when starting forward scanning, the signal output node of (n−2)th GOA unit inputs the high voltage signal as an activation signal.

According to a preferred embodiment of the present invention, for the last GOA unit in the cascade, when starting backward scanning, the signal output node of (n+2)th GOA unit inputs the high voltage signal as an activation signal.

According to a preferred embodiment of the present invention, for the second last GOA unit in the cascade, when starting backward scanning, the signal output node of (n+2) th GOA unit inputs the high voltage signal as an activation signal.

According to a preferred embodiment of the present invention, the GOA circuit is for low temperature polysilicon (LPTS) panel.

According to a preferred embodiment of the present invention, the GOA circuit is for organic light-emitting diode (OLED) panel.

The present invention also provides a GOA circuit, comprising: a plurality of cascade GOA units, for a positive integer n, the n-th GOA unit comprising:

a first thin film transistor (TFT), a gate of the first TFT connected to a constant high voltage, a first source/drain connected to an signal output node of (n−2)th GOA unit, a second source/drain connected to a first source/drain of a ninth TFT;

a ninth TFT, a gate of the ninth TFT connected to the signal output node of the (n−2)th GOA unit, and a second source/drain connected to a third node;

a third TFT, a gate of the third TFT connected to the constant high voltage, a first source/drain connected to an signal output node of (n+2)th GOA unit, a second source/drain connected to a first source/drain of a tenth TFT;

a tenth TFT, a gate of the tenth TFT connected to the signal output node of the (n+2)th GOA unit, and a second source/drain connected to the third node;

a seventh TFT, a gate of the seventh TFT connected to the third node, a source and a drain connected respectively to a second node and a constant low voltage;

a sixth TFT, a gate of the sixth TFT connected to the second node, a source and a drain connected respectively to the third node and the constant low voltage;

a fifth TFT, a gate of the fifth TFT connected to the constant high voltage, a source and a drain connected respectively to the third node and the first node;

an eighth TFT, a gate of the eighth TFT inputted a second clock signal, a source and a drain connected respectively to the second node and the constant high voltage;

a second TFT, a gate of the second TFT connected to the first node, a source and a drain connected respectively to the signal output node of n-th GOA unit and an input first clock signal;

a first capacitor, having the two ends connected respectively to the first node and the signal output node of n-th GOA unit;

a fourth TFT, a gate of the fourth TFT connected to the second node, a source and a drain connected respectively to the signal output node of n-th GOA unit and the constant low voltage;

a second capacitor, having the two ends connected respectively to the second node and the constant low voltage;

wherein the first clock signal and the second clock signal being rectangular waves having a duty ratio of 0.25, and the waveforms between the first clock signal and the second clock signal differing by a half cycle;

wherein for the first GOA unit in the cascade, when starting forward scanning, the signal output node of (n−2)th GOA unit inputting the high voltage signal as an activation signal.

Compared to the known techniques, the present invention provides the following advantages: the GOA circuit of the present invention does not require D2U and U2D control signals to achieve forward and backward scanning, which facilitates the narrow border design; as well as simplify the driving timing corresponding to the GOA circuit to reduce the IC cost.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
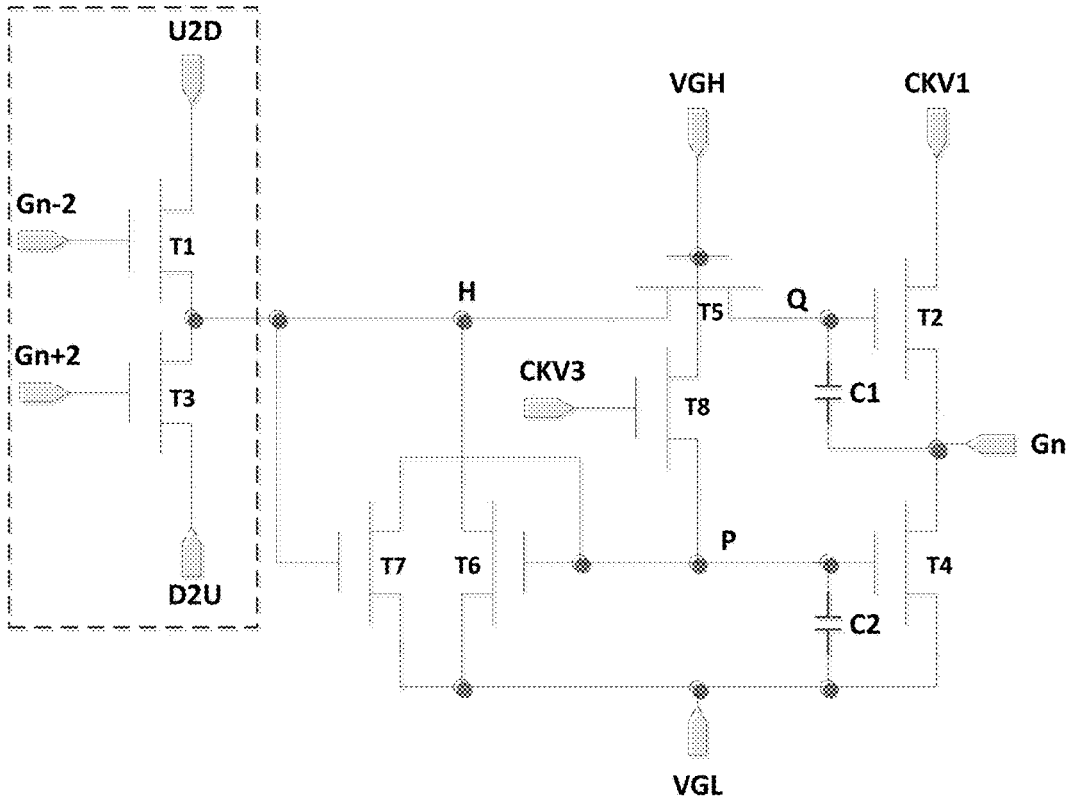
FIG. 1 is a schematic view showing a known GOA circuit.
Figure 2:
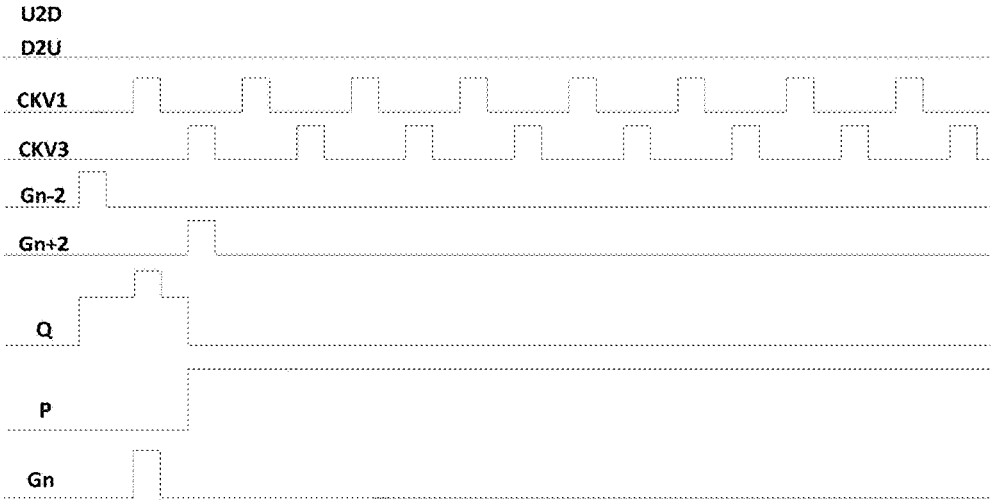
FIG. 2 is a schematic view showing the forward scanning timing for the GOA circuit of FIG. 1.
Figure 3:
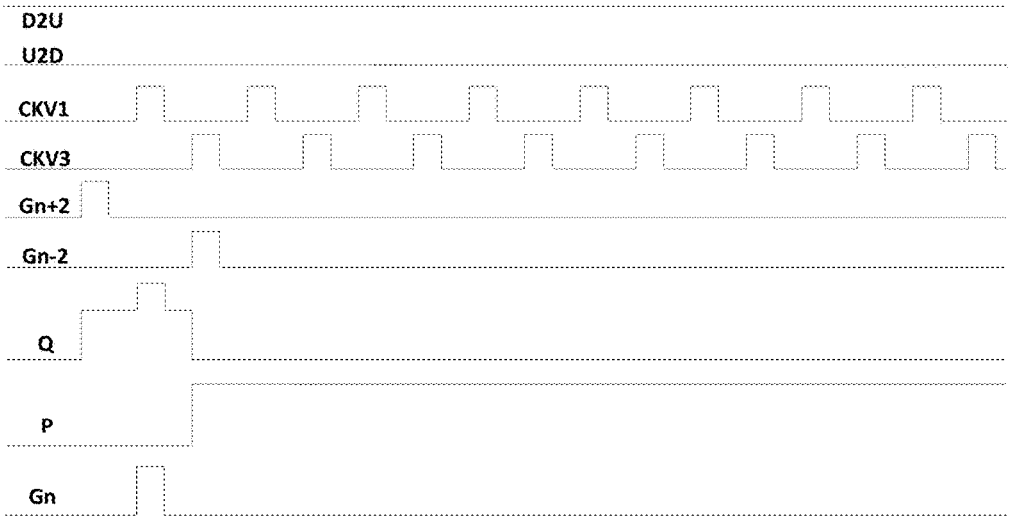
FIG. 3 is a schematic view showing the backward scanning timing for the GOA circuit of FIG. 1.
Figure 4:
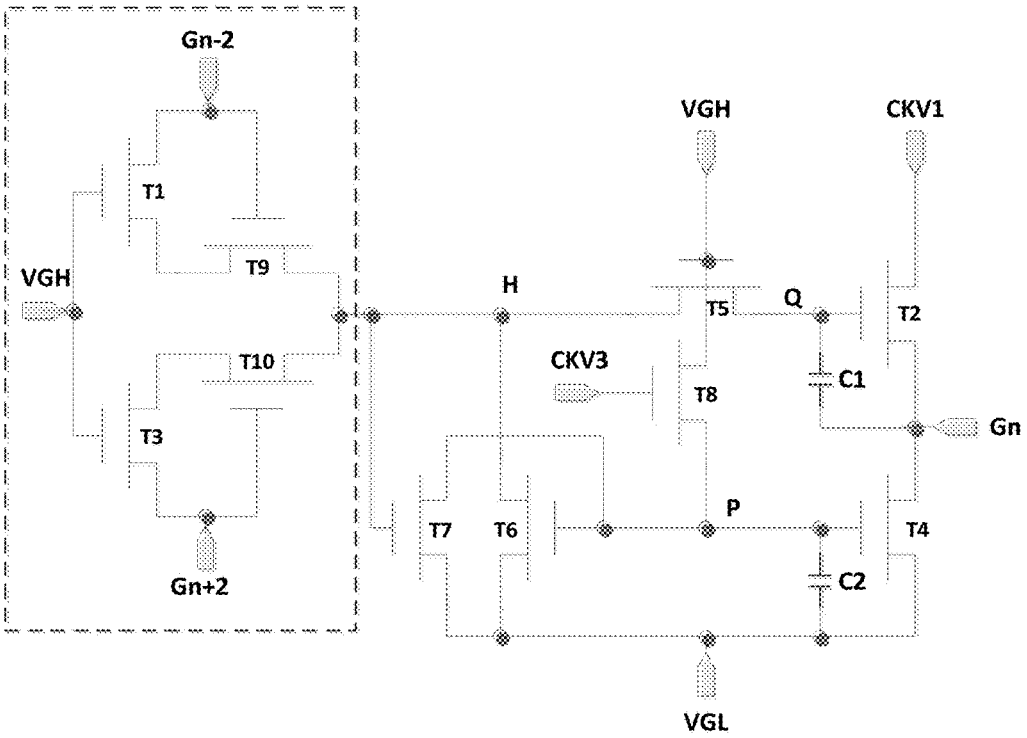
FIG. 4 is a schematic view showing the GOA circuit provided by an embodiment of the present invention.

Refer to FIG. 4. The present invention provides a GOA circuit, applicable to an LTPS panel. The GOA circuit comprises: a plurality of cascade GOA units, for a positive integer n, the n-th GOA unit comprising: a first thin film transistor (TFT) T1, a gate of the first TFT T1 connected to a constant high voltage VGH, a first source/drain connected to the signal output node Gn−2 of (n−2)th GOA unit, and a second source/drain connected to a first source/drain of a ninth TFT T9; a second TFT T2, a gate of the second TFT T2 connected to a node Q, a source and a drain connected respectively to the signal output node Gn of n-th GOA unit and a first input clock signal CKV1; a third TFT T3, a gate of the third TFT T3 connected to the constant high voltage VGH, a first source/drain connected to the signal output node G+2 of (n+2)-th GOA unit, a second source/drain connected to a first source/drain of a tenth TFT T10; a fourth TFT T4, a gate of the fourth TFT T4 connected to a node P, a source and a drain connected respectively to the signal output node Gn and a constant low voltage VGL; a fifth TFT T5, a gate of the fifth TFT T5 connected to the constant high voltage VGH, a source and a drain connected respectively to the node H and the note Q; a sixth TFT T6, a gate of the sixth TFT T6 connected to the node P, the source and a drain connected respectively to the node H and the constant low voltage VGL; a seventh TFT, a gate of the seventh TFT T7 connected to the node H, a source and a drain connected respectively to the node P and the constant low voltage VGL; an eighth TFT T8, a gate of the eighth TFT T8 inputted a clock signal CKV3, a source and a drain connected respectively to the node P and the constant high voltage VGH; a ninth TFT T9, a gate of the ninth TFT T9 connected to the signal output node Gn−2 of (n−2)th GOA unit, a second source/drain connected to the node H; a tenth TFT T10, a gate of the tenth TFT T10 connected to the signal output node Gn+2 of (n+2)th GOA unit, a second source/drain connected to the node H; a first capacitor C1, having the two ends connected respectively to the node Q and the signal output node Gn of n-th GOA unit; and a second capacitor C2, having the two ends connected respectively to the node P and the constant low voltage VGL.

Figure 5:
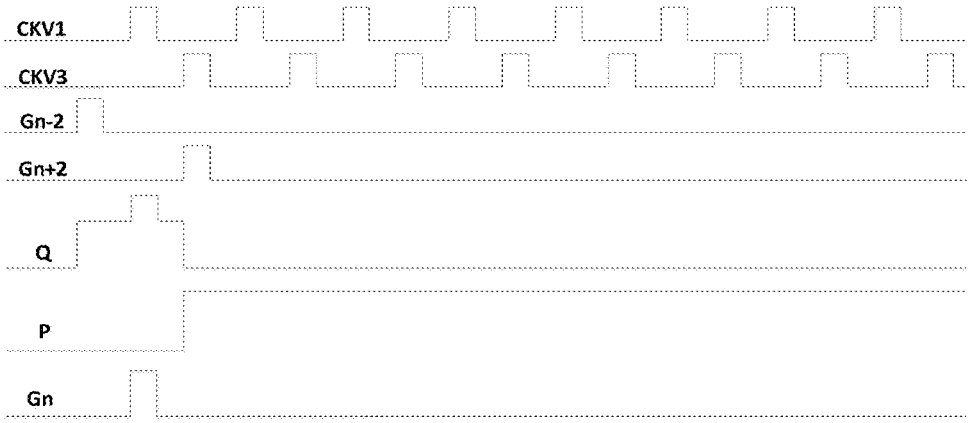
FIG. 5 is a schematic view showing the forward scanning timing for GOA circuit of FIG. 4.

Refer to FIG. 5, which shows a schematic view of timing sequence of forward scanning in the GOA circuit of FIG. 4. Also referring to FIG. 4, the forward scanning of the circuit is described as follows:

Stage 1, pre-charging: Gn−2 is at high voltage, T1 and T9 are conductive, the node H is pre-charged; when node H is at high voltage, T5 stays in conductive state, and the node Q is pre-charged; when node H is at high voltage, T7 is conductive, and node P is lowered down.

Stage 2, Gn outputting high voltage: in Stage 1, the node Q is pre-charged and C1 maintains the charges, T2 is conductive, CKV1 outputs high voltage to Gn.

Stage 3, Gn outputting low voltage: C1 maintains the high voltage of node Q, and the low voltage of CKV1 lowers the Gn.

Stage 4, node Q lowered to VGL: when CKV3 is at high voltage, T8 is conductive, node P is charged, T6 is conductive and node Qn is lowered.

Stage 5, node Q and Gn maintained at low voltage: when node Q becomes at low voltage, T7 is cut-off. When CKV3 jumps to high voltage, T8 is conductive, node P is charged to high voltage, T4 and T6 are conductive to ensure that node Q and Gn are maintained at low voltage; at the same time, C2 keeps node P at high voltage.

In the meantime, the charging unit corresponding to the circuit provides a function to reduce the current leakage at node Q. Specifically, at low voltage maintaining stage, because the gates of T1 and T3 are connected to the constant high voltage VGH and both are conductive. At this point, Gn+2 and Gn−2 are at low voltage. Vds0V. Then, T9 and T10 are both in the state of Vds-0V. As such, the current leakage is reduced to a certain extent.

Figure 6:
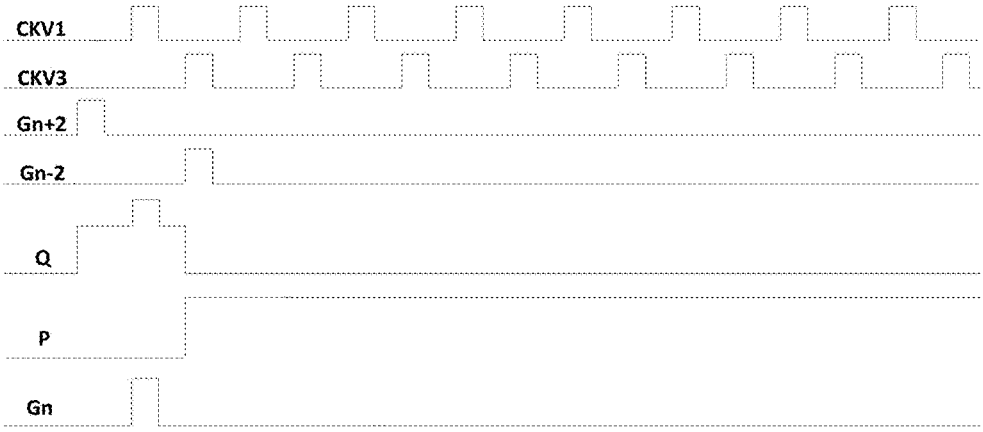
FIG. 6 is a schematic view showing the backward scanning timing for GOA circuit of FIG. 4.

Refer to FIG. 6, which shows a schematic view of timing sequence of backward scanning in the GOA circuit of FIG. 4. Also referring to FIG. 4, the backward scanning of the circuit is described as follows:

Stage 1, pre-charging: Gn+2 is at high voltage, T3 and T10 are conductive, the node H is pre-charged; when node H is at high voltage, T5 stays in conductive state, and node Q is pre-charged; when node H is at high voltage, T7 is conductive and node P is lowered down.

Stage 2, Gn outputting high voltage: in Stage 1, the node Q is pre-charged and C1 maintains the charges, T2 is conductive, CKV1 outputs high voltage to Gn.

Stage 3, Gn outputting low voltage: C1 maintains the high voltage of node Qn, and the low voltage of CKV1 lowers the Gn.

Stage 4, node Q lowered to VGL: when CKV3 is at high voltage, T8 is conductive, node P is charged, T6 is conductive and node Q is lowered.

Stage 5, node Q and Gn maintained at low voltage: when node Q becomes at low voltage, T7 is cut-off. When CKV3 jumps to high voltage, node P is charged to high voltage, then T4 and T6 are conductive to ensure that node Q and Gn are maintained at low voltage; at the same time, C2 keeps node P at high voltage.

In the meantime, the charging unit corresponding to the circuit provides a function to reduce the current leakage at node Q. Specifically, at low voltage maintaining stage, because the gates of T1 and T3 are connected to the constant high voltage VGH and both are conductive. At this point, Gn+2 and Gn−2 are at low voltage. Vds0V. Then, T9 and T10 are both in the state of Vds-0V. As such, the current leakage is reduced to a certain extent.

As shown in FIG. 5 and FIG. 6, both the clock signal CKV1 and the clock signal CKV3 are rectangular waves having a duty ratio of 0.25, and the waveforms between the clock signal CKV1 and the clock signal CKV3 differ by a half cycle.

For the first GOA unit and the second GOA unit in the cascade, when starting forward scanning, the signal output node of (n−2)th GOA unit inputs a high voltage signal as an activation signal.

For the last GOA unit and the second last GOA unit in the cascade, when starting backward scanning, the signal output node of (n+2)th GOA unit inputs a high voltage signal as an activation signal.

The present invention provides a GOA circuit based on LPTS, as shown in FIG. 4, FIG. 5 and FIG. 6. As shown in dashed box of FIG. 4, based on the known GOA circuit, the present invention uses T9 and T10 so that the GOA circuit does not require D2U and U2D control signals to achieve forward and backward scanning functions. This design facilitates narrow-border display, as well as simplifies the driving timing corresponding to the GOA circuit and reduces the IC cost.

The GOA circuit of the present invention can be applied and potentially applied to the following: 1, integrated gate driver circuit on the array substrate of LCD; 2, the gate driving for mobile phones, displays and TVs; 3, advanced technology for LCD and OLED industry; and 4, the circuit stability of the present invention applicable to high-resolution panel.

In summary, the GOA circuit of the present invention can achieve forward and backward scanning functions without D2U and U2D control signals. This design facilitates narrow-border display, as well as simplifies the driving timing corresponding to the GOA circuit and reduces the IC cost.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A gate driver on array (GOA) circuit, comprising a plurality of cascade GOA units, for a positive integer n, the n-th GOA unit comprising:

a first thin film transistor (TFT), a gate of the first TFT connected to a constant high voltage, a first source/drain of the first transistor is directly connected to an signal output node of (n−2)th GOA unit, a second source/drain of the first transistor is directly connected to a first source/drain of a ninth TFT;

a ninth TFT, a gate of the ninth TFT connected to the signal output node of the (n−2)th GOA unit, and a second source/drain of the ninth transistor is directly connected to a third node;

a third TFT, a gate of the third TFT connected to the constant high voltage, a first source/drain of the third transistor is directly connected to an signal output node of (n+2)th GOA unit, a second source/drain of the third transistor is directly connected to a first source/drain of a tenth TFT;

a tenth TFT, a gate of the tenth TFT connected to the signal output node of the (n+2)th GOA unit, and a second source/drain of the tenth transistor is directly connected to the third node;

a seventh TFT, a gate of the seventh TFT connected to the third node, a source and a drain of the seventh transistor are directly connected respectively to a second node and a constant low voltage;

a sixth TFT, a gate of the sixth TFT connected to the second node, a source and a drain of the sixth transistor are directly connected respectively to the third node and the constant low voltage;

a fifth TFT, a gate of the fifth TFT connected to the constant high voltage, a source and a drain of the fifth transistor are directly connected respectively to the third node and the first node;

an eighth TFT, a gate of the eighth TFT inputted a second clock signal, a source and a drain of the eighth transistor are directly connected respectively to the second node and the constant high voltage;

a second TFT, a gate of the second TFT connected to the first node, a source and a drain of the second transistor are directly connected respectively to the signal output node of n-th GOA unit and an first clock signal;

a first capacitor, having the two ends connected respectively to the first node and the signal output node of n-th GOA unit;

a fourth TFT, a gate of the fourth TFT connected to the second node, a source and a drain of the fourth transistor are directly connected respectively to the signal output node of n-th GOA unit and the constant low voltage;

a second capacitor, having the two ends connected respectively to the second node and the constant low voltage.

2. The GOA circuit as claimed in claim 1, wherein the first clock signal and the second clock signal are rectangular waves having a duty ratio of 0.25, and the waveforms between the first clock signal and the second clock signal differ by a half cycle.

3. The GOA circuit as claimed in claim 1, wherein for the first GOA unit in the cascade, when starting forward scanning, the signal output node of (n−2)th GOA unit inputs the high voltage signal as an activation signal.

4. The GOA circuit as claimed in claim 1, wherein for the second GOA unit in the cascade, when starting forward scanning, the signal output node of (n−2)th GOA unit inputs the high voltage signal as an activation signal.

5. The GOA circuit as claimed in claim 1, wherein for the last GOA unit in the cascade, when starting backward scanning, the signal output node of (n+2)th GOA unit inputs the high voltage signal as an activation signal.

6. The GOA circuit as claimed in claim 1, wherein for the second last GOA unit in the cascade, when starting backward scanning, the signal output node of (n+2)th GOA unit inputs the high voltage signal as an activation signal.

7. The GOA circuit as claimed in claim 1, wherein the GOA circuit is for low temperature polysilicon (LPTS) panel.

8. The GOA circuit as claimed in claim 1, wherein the GOA circuit is for organic light-emitting diode (OLED) panel.

9. A gate driver on array (GOA) circuit comprising: a plurality of cascade GOA units, for a positive integer n, the n-th GOA unit comprising:

a first thin film transistor (TFT), a gate of the first TFT connected to a constant high voltage, a first source/drain of the first transistor is directly connected to an signal output node of (n−2)th GOA unit, a second source/drain of the first transistor is directly connected to a first source/drain of a ninth TFT;

a ninth TFT, a gate of the ninth TFT connected to the signal output node of the (n−2)th GOA unit, and a second source/drain of the ninth transistor is directly connected to a third node;

a third TFT, a gate of the third TFT connected to the constant high voltage, a first source/drain of the third transistor is directly connected to an signal output node of (n+2)th GOA unit, a second source/drain of the first third is directly connected to a first source/drain of a tenth TFT;

a tenth TFT, a gate of the tenth TFT connected to the signal output node of the (n+2)th GOA unit, and a second source/drain of the tenth transistor is directly connected to the third node;

a seventh TFT, a gate of the seventh TFT connected to the third node, a source and a drain of the seventh transistor are directly connected respectively to a second node and a constant low voltage;

a sixth TFT, a gate of the sixth TFT connected to the second node, a source and a drain of the sixth transistor are directly connected respectively to the third node and the constant low voltage;

a fifth TFT, a gate of the fifth TFT connected to the constant high voltage, a source and a drain of the fifth transistor are directly connected respectively to the third node and the first node;

an eighth TFT, a gate of the eighth TFT inputted a second clock signal, a source and a drain of the eighth transistor are directly connected respectively to the second node and the constant high voltage;

a second TFT, a gate of the second TFT connected to the first node, a source and a drain of the second transistor are directly connected respectively to the signal output node of n-th GOA unit and an input first clock signal;

a first capacitor, having the two ends connected respectively to the first node and the signal output node of n-th GOA unit;

a fourth TFT, a gate of the fourth TFT connected to the second node, a source and a drain of the fourth transistor are directly connected respectively to the signal output node of n-th GOA unit and the constant low voltage;

a second capacitor, having the two ends connected respectively to the second node and the constant low voltage;

wherein the first clock signal and the second clock signal being rectangular waves having a duty ratio of 0.25, and the waveforms between the first clock signal and the second clock signal differing by a half cycle;

wherein for the first GOA unit in the cascade, when starting forward scanning, the signal output node of (n−2)th GOA unit inputting the high voltage signal as an activation signal.

10. The GOA circuit as claimed in claim 9, wherein for the second GOA unit in the cascade, when starting forward scanning, the signal output node of (n−2)th GOA unit inputs the high voltage signal as an activation signal.

11. The GOA circuit as claimed in claim 9, wherein for the last GOA unit in the cascade, when starting backward scanning, the signal output node of (n+2)th GOA unit inputs the high voltage signal as an activation signal.

12. The GOA circuit as claimed in claim 9, wherein for the second last GOA unit in the cascade, when starting backward scanning, the signal output node of (n+2)th GOA unit inputs the high voltage signal as an activation signal.

13. The GOA circuit as claimed in claim 9, wherein the GOA circuit is for low temperature polysilicon (LPTS) panel.

14. The GOA circuit as claimed in claim 9, wherein the GOA circuit is for organic light-emitting diode (OLED) panel.

* * * * *